United States Patent [19]

Fujita et al.

[11] Patent Number: 4,614,707

[45] Date of Patent: Sep. 30, 1986

[54] COLOR REVERSAL PHOTOGRAPHIC LIGHT-SENSITIVE MATERIALS

[75] Inventors: Munehisa Fujita; Yasuhiro Hayashi; Takashi Ozawa; Nobutaka Ohki, all of Kanagawa, Japan

[73] Assignee: Fuji Photo Film Co., Ltd., Kanagawa, Japan

[21] Appl. No.: 702,564

[22] Filed: Feb. 19, 1985

[30] Foreign Application Priority Data

Feb. 17, 1984 [JP] Japan ..... 59-028136

[51] Int. Cl.[4] ..... G03C 5/50; G03C 1/46; G03C 1/02

[52] U.S. Cl. ..... 430/379; 430/505; 430/506; 430/539; 430/551; 430/567; 430/568

[58] Field of Search ..... 430/551, 567, 571, 568, 430/505, 506, 379, 539

[56] References Cited

U.S. PATENT DOCUMENTS

| | | | |
|---|---|---|---|
| 2,701,197 | 2/1955 | Thirtle et al. | 430/566 |
| 3,620,747 | 11/1971 | Marchant et al. | 430/571 |
| 3,892,572 | 7/1975 | Shiba et al. | 430/543 |
| 4,129,446 | 12/1978 | Lohmann et al. | 430/507 |
| 4,456,682 | 6/1984 | Ishikawa et al. | 430/539 |

*Primary Examiner*—Mary F. Downey
*Attorney, Agent, or Firm*—Sughrue, Mion, Zinn, Macpeak and Seas

[57] ABSTRACT

A color reversal photographic light-sensitive materials comprising a base having thereon (a) at least one light-sensitive silver halide emulsion layer containing a dye forming coupler and (b) a silver halide emulsion layer substantially without light-sensitivity provided adjacent to said light-sensitive layer, or (a) at least one light-sensitive silver halide emulsion layer containing a dye forming coupler, (b) a silver halide emulsion layer substantially without light-sensitivity to light, and (c) an intermediate layer therebetween, wherein said intermediate layer or said silver halide emulsion layer substantially without light-sensitivity, or both said intermediate layer and said silver halide emulsion layer substantially without light-sensitivity contain at least one compound represented by the following formula (I):

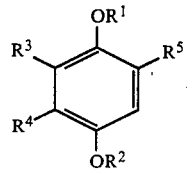

(I)

wherein $R^1$ and $R^2$, which may be the same or different, each represents a hydrogen atom or a group having 1 to 10 carbon atoms capable of being hydrolyzed with alkali, $R^3$, $R^4$ and $R^5$ each represents a hydrogen atom, a sulfo group, a carboxyl group, a sulfoalkyl group having 1 to 6 carbon atoms, a carboxyalkyl group having 1 to 6 carbon atoms or an alkyl group having 1 to 22 carbon atoms, provided that at least one of $R^3$, $R^4$ and $R^5$ is a group selected from a sulfo group, a carboxyl group, a sulfoalkyl group and a carboxyalkyl group, and at least one of $R^3$, $R^4$ and $R^5$ is an alkyl group.

24 Claims, No Drawings

COLOR REVERSAL PHOTOGRAPHIC LIGHT-SENSITIVE MATERIALS

FIELD OF THE INVENTION

The present invention relates to color reversal photographic light-sensitive materials and, particularly, to color reversal photographic light-sensitive materials having improved gradation in the low density section of the characteristic curve.

BACKGROUND OF THE INVENTION

Color reversal photographic light-sensitive materials are generally color photographic light-sensitive materials containing at least three silver halide emulsions each having a different light-sensitivity (typically layers sensitive to light in three regions in the visible light spectrum, namely, red, green or blue). The layers generally contain three color formers (couplers) of cyan, magenta and yellow, which form a positive image by color reversal processing after exposure to light. Color reversal processing generally includes a first development step (black and white development) and subsequent steps of reversal, color development, bleaching and fixation, as in Fuji Processing CR-56. The mechanism of color reversal processing has been explained in detail in, e.g., T. H. James, *The Theory of the Photographic Process,* pages 335–338 (McMillan, 4th ed. 1977).

A determination of the quality of color positive images obtained by color reversal processing of a color reversal light-sensitive material is preferably carried out by taking photographs of various objects. However, a method based upon characteristic curves in which image densities of each light-sensitive material are shown as functions of exposure amount, and evaluating the quality of color positive images using the shape of these characteristic curves, is ordinary used as a substitute by persons skilled in the art.

As described in Eiji Hozumi, *Sensitometry no Jissai,* page 156 (1st ed. October, 1970) in color reversal photographic light-sensitive materials, color reproduction characteristics and tone reproduction characteristics of an image are determined by the gradation of characteristic curves of three colors of cyan, magenta and yellow and the balance of gradation among the three colors. Particularly, the gradation of the low density section (i.e., in a reversal image) in the characteristic curve has a great influence upon color reproduction characteristics and tone reproduction characteristics. In conventional color reversal photographic light-sensitive materials, since gradation of the low density section is too soft, reduction of density corresponding to increase of the exposure amount is insufficient, resulting in the disadvantage that only an impure white color having a high density is obtained by reproduction in the color image, although the object to be photographed is white.

Various efforts have been made to improve the color reproduction characteristics of color reversal photographic light-sensitive materials, but they can not improve the gradation of the low density section in the above described characteristic curves to provide a sufficiently hard tone. For example, a technique of improving color brilliancy by an integrated layer effect, i.e., by providing a silver halide emulsion layer spectrally sensitized in a spectral region different from the adjacent light-sensitive silver halide emulsion layer (for example, a red-sensitized light sensitive halide emulsion layer which is subjected to gold sensitization, provided on a blue-sensitive emulsion layer) in the color reversal photographic light-sensitive materials is described in U.S. Pat. No. 3,728,121. However, gradation of the low density section of the characteristic curves is not improved to provide a hard tone by this technique.

An object of the present invention is to provide color reversal photographic light-sensitive materials having improved gradation of the low density section of the characteristic curves or reversal image, i.e., a hard tone and improved reduction of density corresponding to increase of the exposure amount.

In attempting to improve color reproduction characteristic, the persent inventors have attempted to use a silver halide emulsion layer having substantially no light-sensitivity provided adjacent to the light-sensitive silver halide emulsion layer in the color reversal photographic light-sensitive material either directly or with an intermediate layer. By this means, it was expected that gradation of the low density section of the characteristic curves of the reversal image could be improved so as to have a hard tone by trapping halogen ions formed by the first development of the light-sensitive silver halide emulsion (this halogen ion is easily formed in high exposure areas, i.e., those corresponding to the low density section of the characteristic curve of the reversal image) with silver halide emulsion grains having substantially no light-sensitivity to reduce development restraint of the light-sensitive silver halide emulsion caused by the presence of this halogen ion (i.e., to accelerate development).

However, unexpectedly it was discovered that gradation of the low density section of the characteristic curve obtained with this material after complete color reversal development processing was not improved as compared with the prior color reversal photographic light-sensitive materials in which the silver halide emulsion layer having substantially no light-sensitivity was absent.

As a result of further minute analyses and experiments, it was discovered that, in the course of complete color reversal processing, residual emulsion grains which were not developed by the first development step in the auxiliary silver halide emulsion layer (i.e., having substantially no light-sensitivity) provided centers of development on their surfaces in subsequent reversal development steps after the first development step. Because of this, the auxiliary emulsion was changed into an emulsion capable of contributing to color formation in color development. If a dye forming coupler containing layer is present near this auxiliary layer, an oxidation product of a developing agent formed by development of the substantially insensitive silver halide emulsion in the auxiliary layer, which does not essentially contribute to formation of an image, nonetheless has some influence upon color formation of the dye forming coupler containing layer. For this reason, the expected results were not obtained.

SUMMARY OF THE INVENTION

The present inventors have now found that these and other objects of the present invention are attained by providing color reversal photographic light-sensitive materials comprising a support having thereon (a) at least one light-sensitive silver halide emulsion layer containing a dye forming coupler and (b) a silver halide emulsion layer substantially without light-sensitivity provided adjacent to the light-sensitive layer, or (a) at least one light-sensitive silver halide emulsion layer containing a dye forming coupler, (b) a silver halide emulsion layer substantially without light-sensitivity, and (c) an intermediate layer therebetween, wherein the intermediate layer, the silver halide emulsion layer substantially without light-sensitivity, or both contain at least one compound represented by the following formula (I):

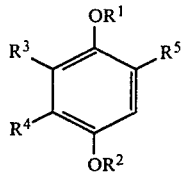

(I)

In the formula, $R^1$ and $R^2$, which may be the same or different, each represents a hydrogen atom or a group having 1 to 10 carbon atoms capable of being hydrolyzed with alkali, $R^3$, $R^4$ and $R^5$ each represents a hydrogen atom, a sulfo group, a carboxyl group, a sulfoalkyl group having 1 to 6 carbon atoms, a carboxyalkyl group having 1 to 6 carbon atoms or an alkyl group having 1 to 22 carbon atoms, provided that at least one of $R^3$, $R^4$ and $R^5$ is a group selected from a sulfo group, a carboxyl group, a sulfoalkyl group and a carboxyalkyl group, and at least one of $R^3$, $R^4$ and $R^5$ is an alkyl group.

DETAILED DESCRIPTION OF THE INVENTION

Compounds represented by general formula (I) are described as color fog preventing agents, e.g., in British Patent No. 891,158, U.S. Pat. No. 2,701,197 etc. However, only the above described compounds of many color fog preventing agents and color stain preventing agents known hitherto are effective for the purpose of the present invention.

In general formula (I), examples of groups represented by $R^1$ and $R^2$ which are capable of being hydrolyzed with alkali include an acyl group such as an acetyl group, a trichloroacetyl group, benzoyl group, etc., and a carbonic acid ester group such as an ethoxycarbonyl group, etc. Examples of groups represented by $R^3$, $R^4$ and $R^5$ include a 1,1-dimethyl-2-sulfoethyl group, a 3-sulfopropyl group, etc. as a sulfoalkyl group; a 5-carboxylpentyl group as a carboxyalkyl group; and a methyl group, an ethyl group, a t-octyl group, a n-octyl group, a sec-dodecyl group, a n-pentadecyl group, and a sec-octadecyl group as an alkyl group.

In general formula (I), $R^1$ and $R^2$ preferably each represents a hydrogen atom, and $R^3$, $R^4$ and $R^5$ preferably each represents a sulfo group, a carboxyl group, or an alkyl group. More preferably $R^5$ represents a sulfo group or a carboxyl group, one of $R^3$ and $R^4$ represents an alkyl group, and the other represents a hydrogen atom.

Most preferably $R^3$ represents a hydrogen atom, $R^4$ represents an alkyl group and $R^5$ represents a sulfo group.

The compounds represented by the general formula (I) can be synthesized according to the processes described in British Patents Nos. 891,158 and 731,301 and U.S. Pat. No. 2,701,197, or by analogous processes.

In the following, specific examples of compounds represented by general formula (I) of the present invention are described, but the present invention is not limited to them.

(1)

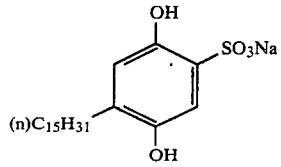

(2)

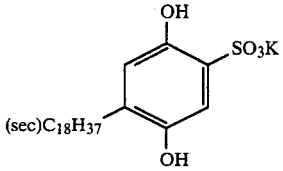

(3)

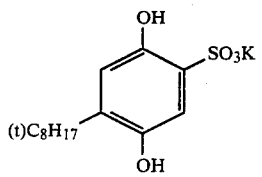

(4)

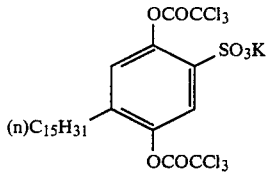

(5)

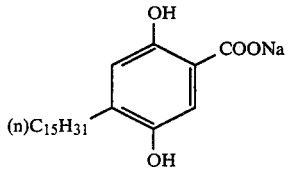

(6)

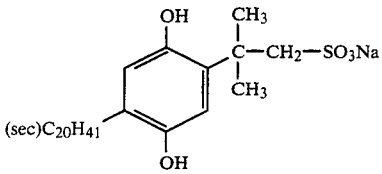

(7)

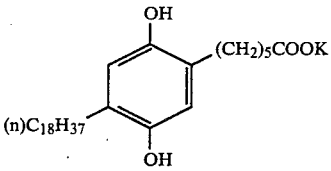

(8)

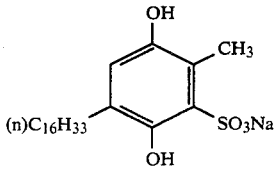

(9)

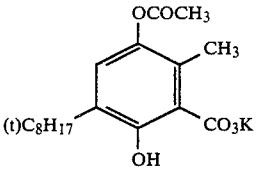

-continued (10)

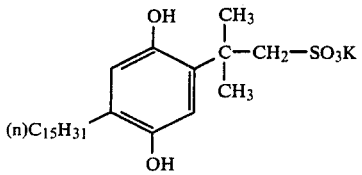

(11)

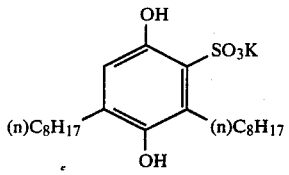

(12)

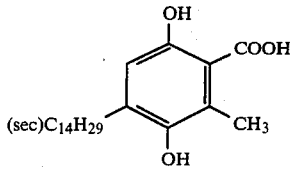

(13)

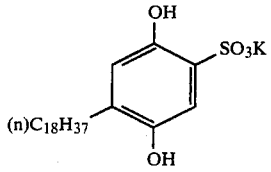

(14)

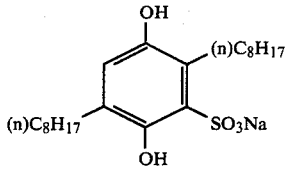

(15)

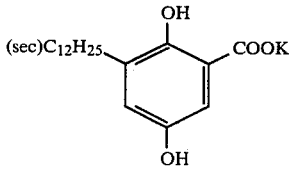

(16)

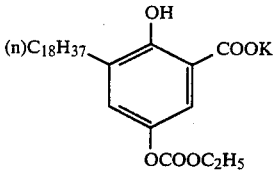

(17)

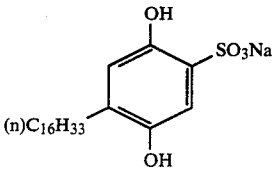

The compounds represented by general formula (I) are used in order to prevent the silver halide emulsion having substantially no light-sensitivity from taking part in color formation in the color development step.

The compounds are hydroquinone compounds having at least one water soluble group such as a sulfo group, which can be used as a solution obtained by dissolving them in water or various organic solvents such as a methanol, an ethanol and an iso-propanol.

In the silver halide emulsion having substantially no light-sensitivity used in the present invention, any silver halide composition substantially without light-sensitivity may be used, including silver chloride, silver bromide, silver iodobromide, or silver chloroiodobromide. With respect to particle size, fine grains are preferred, and it is preferred to use finer crystals than light-sensitive silver halide grains used for the image forming layers. They are particularly preferred to have an average particle size of about 7.5$\mu$ or less and, more preferably, about 0.1$\mu$ or less. The shape of the grains is not particularly restricted, and either regular grains or irregular grains may be used. The dispersibility of the grains may be either multidispersion or monodispersion. This silver halide emulsion is defined in the present invention as a "silver halide emulsion substantially without light-sensitivity", and the term "substantially without light-sensitivity" means that the emulsion is insensitive in relation to the most adjacent light-sensitive silver halide emulsion layer. More specifically, this term is used to indicate that when light energy necessary to expose the light-sensitive silver halide is applied to the light-sensitive material of the present invention, the light-insensitive emulsion is substantially not affected by the light energy. In greater detail, it is preferred that the silver halide grains having substantially no light-sensitivity of the present invention are fine grains of silver halide having, generally, a light-sensitivity of at most only about 1/10 based on the above described light-sensitive silver halide grains. Although the silver halide grains having substantially no light-sensitivity of the present invention may have fog centers, it is preferred that they do not have fog centers.

In the present invention, the silver halide emulsion having substantially no light-sensitivity and the compound represented by general formula (I) are contained in a layer provided adjacent to an image forming layer corresponding to the part where gradation in the characteristic curve is intended to improve, either directly adjacent or with an intermediate layer. Preferably, the layer is provided under the image forming layer. More preferably, the layer is provided under the image forming layer nearest to the base. The silver halide emulsion having substantially no light-sensitivy and the compound represented by general formula (I) may be contained in the same layer or may be contained in different layers. However, when they are contained in different layers, it is preferred that the layer containing the compound represented by general formula (I) be provided between the image forming layer and the silver halide emulsion layer having substantially no light-sensitivity.

In the present invention, the amount of the compound represented by general formula (I) used is preferred to be in a range of about 0.01 to about 1.00 mols per mole of silver halide substantially without light-sensitivity in a case that the compound and the silver halide emulsion substantially without light-sensitivity are contained in the same layer, and is preferred to be in a range of about $0.4\times10^{-4}$ mols to about $6\times10^{-4}$ mols/m$^2$ in a case that the compound is incorporated in the different layer from the layer wherein the silver halide emulsion substantially without light-sensitivity is contained. Further, in the light-sensitive material of the present invention, the amount of silver halide substantially without light-sensitivity is preferably in a range about 0.01 to 1.00 mol per mol of light-sensitive silver halide in a case that the layer containing silver halide emulsion substantially without light-sensitivity is adjacent to the light-sensitive silver halide emulsion layer, and is preferably in a range of about $10^{-4}$ mols/m$^2$ to about $10^{-2}$ mols/m$^2$ in a case that the layer containing silver halide emulsion substantially without light-sensitivity is not adjacent to the light-sensitive silver halide emulsion layer.

In the present invention, the silver halide emulsion having substantially no light-sensitivity may be used by adsorbing sensitizing dyes on the surface of grains of adsorbing various compounds for stabilizing, especially in controlling halogen ions trap, on the surface of grains. Examples of useful sensitizing dyes are those described in German Patent No. 929,080, U.S. Pat. Nos. 2,493,748, 2,503,776, 2,519,001, 2,912,329, 3,656,959, 3,672,897, 3,694,217, 4,025,349 and 4,046,572, British Patent No. 1,242,588, and Japanese Patent Publication Nos. 14030/69 and 24844/77.

These sensitizing dyes may be used alone, but they can be used in combination. For the purpose of stabilizing performance, it is possible to use various stabilizers, such as azoles, for example, benzothiazolium salts, nitroindazoles, triazoles, benzotriazoles, benzoimidazoles, (Particularly, those which are nitro- or halogen substituted); heterocyclic mercapto compounds, for example, mercaptothiazoles, mercaptobenzothiazoles, mercaptobenzimidazoles, mercaptothiadiazoles, mercaptotetrazoles (particularly, 1-phenyl-5-mercaptotetrazole) and mercaptopyrimidines the above-described heterocyclic mercapto compounds substituted with water soluble groups such as a carboxyl group or a sulfo group; thioketo compounds, for example, oxazolinethione; azaindenes, for example, tetrazaindenes (particularly, 4-hydroxy substitute-(1,3,3a,7)tetrazaindenes); benzenethiosulfonic acid; and benzenesulfinic acid.

In the light-sensitive silver halide emulsions used in the present invention, any of silver bromide, silver iodide, silver iodobromide, silver chlorobromide, silver chloroiodobromide and silver chloride capable of forming a latent image by imagewise exposure may be used.

The average particle size (defined as particle diameter in the case of spherical or nearly spherical particles, and edge length in the case of cubic particles, calculated as an average based on projected area) of light-sensitive silver halide grains in the above described photographic emulsions is not particularly limited, but it is preferably about 3$\mu$ or less.

The particle size distribution may be either narrow or broad.

The silver halide grains in the photographic light-sensitive emulsions may have a regular crystal form, e.g., cubic or octahedral, or an irregular crystal form such as spherical or plate-form, or those having a composite form thereof. They may be composed of a mixture of various different crystal forms.

Emulsions in which superflat silver halide grains having a diameter of 5 times or more their thickness constitute 50% or more of the whole projected area may be used.

The inner core and the surface layer of the silver halide grains may have different compositions.

The photographic emulsions used in the present invention can be prepared by the processes described in P. Glafkides, *Chimie et Physique Photographique,* pages 329–425 (Paul Montel, 1967), G. F. Duffin, *Photographic Emulsion Chemistry,* pages 57–82 (The Focal Press, 1966), V. L. Zelikman et al, *Making and Coating Photographic Emulsions,* pages 69–87 (The Focal Press, 1964), etc. Namely, any of an acid process, a neutral process and an ammonia process may be used. In reacting soluble silver salts with soluble halogen salts, any of single-jet process, a double-jet process and a combination of them may be used.

A process for forming grains in the presence of excess silver ion (the "back-mixing" process) can be used. As an example of the simultaneous mixing process, a process can be used in which the pAg in a liquid phase where silver halide is formed is kept constant, i.e., the "controlled double jet" process.

According to this process, silver halide emulsions having a regular crystal form and a nearly uniform particle size are obtained.

Two or more silver halide emulsions prepared separately may be mixed for use.

During formation of silver halide grains or physical ripening thereof, cadmium salts, zinc salts, lead salts, thallium salts, iridium salts or complex salts thereof, rhodium salts or complex salts thereof, or iron salts or complex salts thereof, may be allowed to coexist.

After precipitation or after physical ripening, soluble salts are removed, generally, from the emulsions, by conventional methods such as, e.g., a noodle water wash process in which gelatin is gelatinized or a precipitation process (flocculation) utilizing inorganic salts having a polyvalent anion, for example, sodium sulfate, anionic surface active agents, anionic polymers (for example, polystyrenesulfonic acid) or gelatin derivatives (for example, aliphatically acylated gelatin, aromatically acylated gelatin, aromatically carbamoylated gelatin).

The silver halide emulsions are usually chemically sensitized. In order to carry out chemical sensitization, processes described in, for example, H. Frieser, *Die Grundlagender Photographischen Prozesse mit Silberhalogeniden,* pages 675–734 (Akademische Verlagsgesellschaft, 1968) can be used.

Namely, sulfur sensitization using sulfur containing compounds capable of reacting with active gelatin or silver (for example, thiosulfates, thioureas, mercapto compounds, and rhodanines); reduction sensitization using reductive substances (for example, stannous salts, amines, hydrazine derivatives, formamidine sulfinic acid, and silane compounds); and noble metal sensitization using noble metal compounds (for example, complex salts of group VIII metals such as Pt, Ir, and Pd as well as gold complex salts) can be used alone or in combination.

In the light-sensitive photographic emulsion layers used in the present invention, at least a green-sensitive emulsion layer contains methine dyes and other spectral sensitizing dyes. Examples of dyes used include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes.

Useful sensitizing dyes are described in, for example, German Patent No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent No. 1,242,588, and Japanese Patent Publication Nos. 14030/69 and 24844/77.

These sensitizing dyes may be used alone or in combination, and a combination of sensitizing dyes is often used particularly for the purpose of supersensitization. Typical examples are described in U.S. Pat. Nos.

2,688,545, 2,977;229, 3,397,060, 3,522,052, 3,527,641, 3,617,293, 3,628,964, 3,666,480, 3,672,897, 3,679,428, 3,703,377, 3,769,301, 3,814,609, 3,837,862 and 4,026,707, British Patents Nos. 1,344,281 and 1,507,803, Japanese Patent Publication Nos. 4936/68 and 12375/78, and Japanese Patent Application (OPI) Nos. 110618/77 and 109925/77 (the term "OPI" as used herein refers to a "published unexamined Japanese patent application").

Dyes which do not themselves have a spectrally sensitizing effect or substances which do not substantially absorb visible light but have a supersensitizing effect may be incorporated in the emulsions together with the sensitizing dyes. For example, aminostyryl compounds substituted by a nitrogen containing heterocyclic group (for example, those described in U.S. Pat. Nos. 2,933,390 and 3,635,721), aromatic acid-formaldehyde condensates (for example, those described in U.S. Pat. No. 3,743,510), cadmium salts and azaindene compounds may be used.

The combinations described in U.S. Pat. Nos. 3,615,613, 3,615,641, 3,617,295 and 3,635,721 are particularly useful.

The present invention is applied to multilayer multicolor photographic materials having photographic light-sensitive layers with at least three different spectral sensitivities on a base.

Such multilayer natural color photographic materials generally have at least one red-sensitive emulsion layer, at least one green-sensitive emulsion layer and at least one blue-sensitive emulsion layer on a base. The order of these layers is arbitrarily selected as described. Generally, the red-sensitive emulsion layer contains a cyan forming coupler, the green-sensitive emulsion layer contains a magenta forming coupler and the blue-sensitive emulsion layer contains a yellow forming coupler, but other combinations can be utilized, if necessary.

In the light-sensitive photographic emulsion layers of the photographic light-sensitive materials produced according to the present invention, dye forming couplers, i.e., compounds capable of forming a colored dye by oxidative coupling with an aromatic primary amine developing agent (for example, phenylenediamine derivatives or aminophenol derivatives) in color development processing are used together. For example, magenta couplers include 5-pyrazolone couplers, pyrazolobenzimidazole couplers, cyanoacetylcoumarone couplers and open-chain acylacetonitrile couplers, yellow couplers used in blue-sensitive layers include acylacetamide couplers (for example, benzoylacetanilides and pivaloylacetanilides), and cyan couplers used in red-sensitive layers include naphthol couplers and phenol couplers. It is preferred that these couplers are nondiffusible couplers having a hydrophobic group a called ballast group in the molecule or polymeric couplers. Couplers may be either 4 equivalent or 2 equivalent to silver ions. The couplers may be colored couplers having a color correction effect or couplers which release a development inhibitor by development ("DIR couplers").

In addition to DIR couplers, non-coloring DIR coupling compounds which produce a colorless product by a coupling reaction and release a development inhibitor, may be used.

Non-DIR compounds which release a development inhibitor by development may be contained in light-sensitive materials.

In order to satisfy characteristics required for the light-sensitive materials, two or more kinds of the above described couplers can be incorporated in the same layer. The same compound may be, of course, added to two or more layers.

It is advantageous to select the photographic color couplers used so as to give a middle scale image. It is preferred that the maximum absorption zone of a cyan dye formed from a cyan coupler is between about 60 and 720 nm, the maximum absorption zone of a magenta dye formed from a magenta coupler is between about 500 and 580 nm, and the maximum absorption zone of a yellow dye formed from a yellow coupler is between about 400 and 480 nm.

In order to introduce couplers into silver halide emulsion layers, known processes, for example, the process described in U.S. Pat. No. 2,322,027, can be used.

Examples of useful couplers are as follows.

Examples of magenta color couplers include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Patent No. 1,810,464, West German Patent Application (OLS) Nos. 2,408,665, 2,417,945, 2,418,959 and 2,424,467, Japanese Patent Publication No. 6031/65, and Japanese Patent Application (OPI) Nos. 20826/76, 13041/75, 58922/77, 129538/74, 74027/74, 159336/75, 42121/77, 74028/74, 60233/75, 26541/76 and 55122/78.

Examples of yellow color couplers include those described in U.S. Pat. Nos. 2,875,057, 3,265,506, 3,408,194, 3,551,155, 3,582,322, 3,725,072 and 3,891,445, West German Patent No. 1,547,868, West German Patent Application (OLS) Nos. 2,219,917, 2,261,361 and 2,414,006, British Patent 1,425,020, Japanese Patent Publication No. 10783/76, and Japanese Patent Application (OPI) Nos. 26133/72, 73147/73, 102636/76, 6341/75, 123342/75, 130442/75, 21827/76, 87650/77, 82424/77 and 115219/77.

Examples of cyan couplers include those described in U.S. Pat. Nos. 2,369,929, 2,434,272, 2,474,293, 2,521,908, 2,895,826, 3,034,982, 3,311,476, 3,458,315, 3,476,563, 3,583,971, 3,591,383, 3,767,411 and 4,004,929, West German Patent Application (OLS) Nos. 2,414,830 and 2,454,329, and Japanese Patent Application (OPI) Nos. 59838/73, 26034/76, 5055/73, 146828/76, 69624/77 and 90932/77.

As binders or protective colloids used in emulsion layers or intermediate layers in the light-sensitive materials of the present invention, gelatin is advantageously used, but other hydrophilic colloids may be used as well.

For example, it is possible to use proteins such as gelatin derivatives, graft polymers of gelatin and other high polymers, albumin and casein; sugar derivatives such as cellulose derivatives including hydroxyethyl cellulose, carboxymethyl cellulose and cellulose sulfate, sodium alginate and starch derivatives; and various synthetic hydrophilic high polymer substances such as homopolymers or copolymers including polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole.

As gelatin, acid-processed gelatin or enzyme-processed gelatin described in *Bull. Soc. Sci. Phot. Japan*, No. 16, p. 30 (1966) may be used as well as lime-processed gelatin, and gelatin hydrolyzates or enzyme-decomposition products.

Various compounds may be incorporated in the photographic emulsions used in the present invention, for the purpose of preventing fog during production of light-sensitive materials, during preservation or during photographic processing, or for stabilizing photographic performance. Namely, it is possible to add various antifogging agents or stabilizers, such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (particularly, 1-phenyl-5-mercaptotetrazole); mercaptopyrimidines; mercaptotriazines; thioketo compounds such as oxazolinthione; azaindenes, for example, triazaindenes, tetrazaindenes (particularly, 4-hydroxy substituted-(1,3,3a,7)-tetrazaindenes) and pentazaindenes; benzenethiosulfonic acid, benzenesulfinic acid, and benzenesulfonic acid amide.

In the photographic light-sensitive materials of the present invention, the photographic emulsion layers and other hydrophilic colloid layers may contain inorganic or organic hardening agents. For example, chromium salts (e.g., chromium alum or chromium acetate), aldehydes (e.g., formaldehyde, glyoxal or glutaraldehyde), N-methylol compounds (e.g., dimethylolurea or methyloldimethylhydantoin), dioxane derivatives (e.g., 2,3-dihydroxydioxane), active vinyl compounds (e.g., 1,3,5-triacryloyl-hexahydro-s-triazine or 1,3-vinylsulfonyl-2-propanol), active halogen compounds (e.g., 2,4-dichloro-6-hydroxy-s-triazine), mucohalogenic acids (e.g., mucochloric acid or mucophenoxychloric acid) can be used alone or in combination.

The light-sensitive materials produced according to the present invention may contain hydroquinone derivatives, aminophenol derivatives, gallic acid derivatives, or ascorbic acid derivatives as color stain preventing agents, including those described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77, and Japanese Patent Publication No. 23813/75.

In the light-sensitive materials of the present invention, fading preventing agents can be used alone or in combination of two or more. Known fading preventing agents include hydroquinone derivatives, gallic acid derivatives, p-alkoxyphenols, p-oxyphenol derivatives and bisphenols.

Examples of hydroquinone derivatives are described in U.S. Pat. Nos. 2,360,290, 2,418,613, 2,675,314, 2,701,197, 2,704,713, 2,728,659, 2,732,300, 2,735,765, 2,710,801 and 2,816,028, and British Pat. No. 1,363,921; gallic acid derivatives are described in U.S. Pat. Nos. 3,457,079 and 3,069,262; p-alkoxyphenols are described in U.S. Pat. Nos. 2,735,765 and 3,698,909 and Japanese Patent Publication Nos. 20977/74 and 6623/77; p-oxyphenol derivatives are described in U.S. Pat. Nos. 3,432,300, 3,573,050, 3,574,627 and 3,764,337 and Japanese Patent Application (OPI) Nos. 35633/77, 147434/77 and 152225/77; and phenols are described in U.S. Pat. No. 3,700,455.

The light-sensitive materials of the present invention can further contain antistatic agents, plasticizers, matting agents, lubricants, ultraviolet ray absorbing agents, fluorescent whitening agents, and air fog-preventing agents.

Photographic processing of the light-sensitive materials of the present invention can be carried out according to any of known color reversal image forming processes as described in, for example, *Research Disclosure,* Vol. 176, pages 28–30, (December, 1978). Processing temperature in generally preferred to be between about 18° C. and 60° C.

The color reversal light-sensitive material, which is a preferable embodiment of the present invention is generally processed by the steps of: black-white development (first development)→stopping→water wash→reversing→water wash→color development→stopping→water wash→conditioning bath→water wash→bleaching→water wash→fixing→water wash→stabilizing→drying. In addition, a previous bath, a prehardening bath, and a neutralizing bath, may be provided in sequence in this process. Water wash after the stopping, reversing, color development, conditioning or bleaching may be omitted. The reversing may be carried out in a fogging bath, or may be carried out by re-exposure. This step can be omitted by adding a fogging agent to the color development bath. Further, the conditioning bath may be omitted.

In the first developing solution used in the present invention, known developing agents may be used, including dihydroxybenzenes (for example, hydroquinone), 3-pyrazolidones (for example, 1-phenyl-3-pyrazolidone), aminophenols (for example, N-methyl-p-aminophenol), 1-phenyl-3-pyrazolines, ascorbic acid, and heterocyclic compounds wherein a 1,2,3,4-tetrahydroquinoline ring is fused to an indolenine ring described in U.S. Pat. No. 4,067,872 which may be used alone or in combination.

In the black-white developing solution used in the present invention, it is possible to incorporate, as desired, preservatives (for example, sulfites and bisulfites), buffering agents (for example, carbonates, boric acid, borates or alkanolamines), alkali agents (for example, hydroxides or carbonates), dissolving aids (for example, polyethylene glycols or polyethylene glycol esters), pH controlling agents (for example, organic acids such as acetic acid), sensitizers (for example, quaternary ammonium salts), development accelerators, surface active agents, toning agents, defoaming agents, hardeners and viscosity increasing agents.

In the first developing solution used in the present invention, it is necessary to incorporate a compound which serves as a silver halide solvent. Usually, the above described sulfites added as preservatives serve as the solvent. Useful sulfites and other silver halide solvents include, for example, KSCN, NaSCN, $K_2SO_3$, $Na_2SO_3$, $K_2S_2O_5$, $Na_2S_2O_5$, $K_2S_2O_3$ and $Na_2S_2O_3$.

When the amount of these silver halide solvents is too small, development is slow, while when it is too large, the silver halide emulsion is fogged. A suitable amount can be easily determined by persons skilled in the art.

For example, $SCN^-$ is preferably used in an amount of from about 0.005 to 0.02 mols, particularly, about 0.01 to 0.015 mols, per liter of the developing solution, and $SO_3^{2-}$ is preferably used in an amount of from about 0.05 to 1 mol, particularly, about 0.1 to 0.5 mols.

Further, the first developing solution can include antifogging agents (for example, halides such as potassium bromide or sodium bromide, benzimidazoles, benzotriazoles, benzothiazoles, tetrazoles and thiazoles), and chelating agents (for example, ethylenediaminetetraacetic acid, alkali metal salts thereof, polyphosphates, and nitrilotriacetic acid salts).

The pH of the developing solution prepared as described above is selected so as to give sufficient desired density and contrast, and is preferably from about 8.5 to about 11.5.

The fogging bath used in the present invention can contain known fogging agents, including stannous ion complex salts such as stannous ion-organophosphoric acid complex salts disclosed in U.S. Pat. No. 3,617,282, stannous ion-organophosphonocarboxylic acid complex salts disclosed in Japanese Patent Publication No. 32616/81, stannous ion-aminopolycarboxylic acid complex salts disclosed in British Pat. No. 1,209,050, boron compounds such as boron hydride compounds disclosed in U.S. Pat. No. 2,984,567, and heterocyclic amine borane compounds disclosed in British Pat. No. 1,011,000. The pH of the fogging bath (reversal bath) ranges widely from acid to alkali, and it is in a range of about 2 to 12, preferably about 2.5 to 10, particularly preferably about 3 to 9.

The color developing solution used in the present invention is a general color developing solution containing an aromatic primary amine developing agent. Preferred examples of the aromatic primary amine color developing agents include p-phenylenediamine derivatives, e.g., N,N-diethylphenylenediamine, 2-amino-5-diethylaminotoluene, 2-amino-5-(N-ethyl-N-laurylamino)toluene, 4-(N-ethyl-N-(β-hydroxyethyl-)amino)aniline, 2-methyl-4-(N-ethyl-N-(β-hydroxyethyl)amino)aniline, N-ethyl-N-(β-methanesulfonamidoethyl)-3-methyl-4-aminoaniline, N-(2-amino-5-diethylaminophenylethyl)methanesulfonamide, N,N-dimethyl-p-phenylenediamine, 4-amino-3-methyl-N-ethyl-N-methoxyethylaniline described in U.S. Pat. Nos. 3,656,950 and 3,698,525, 4-amino-3-methyl-N-ethyl-N-β-ethoxyethylaniline and 4-amino-3-methyl-N-ethyl-N-β-butoxyethylaniline and their salts (for example, sulfates, hydrochlorides, sulfites and p-toluenesulfonic acids).

The color developing solution may further contain other conventional developer additives, for example, alkali agents and buffering agents such as sodium hydroxide, potassium hydroxide, sodium carbonate, potassium carbonate, sodium tertiary phosphate or potassium tertiary phosphate, potassium metaborate or borax, used alone or in combination.

In the color developing solution, sulfites (for example, sodium sulfite, potassium sulfite and sodium bisulfite) are typically used as preservatives. Hydroxylamine can be added, if desired.

Suitable development accelerators can be added to the color developing solution as occasion demands. For example, it is possible to use pyridinium compounds and other cationic compounds described in U.S. Pat. No. 2,648,604, Japanese Patent Publication No. 9503/69 and U.S. Pat. No. 3,671,247, cationic dyes such as phenosafranine, neutral salts such as thallium nitrate or potassium nitrate, nonionic compounds such as polyethylene glycol and derivatives thereof, polythioethers described in Japanese Patent Publication No. 9504/69, U.S. Pat. Nos. 2,533,990, 2,531,832, 2,950,970 and 2,577,127, organic solvents described in Japanese Patent Publication No. 9509/69 and Belgian Patent No. 682,862, organic amines such as ethanolamine, ethylenediamine and diethanolamine, and accelerators described in L. F. A. Mason, *Photographic Processing Chemistry*, p. 40–43 (Focal Press, London, 1966).

The color developing solution may further contain aminopolycarboxylic acids exemplified by ethylenediaminetetraacetic acid, nitrilotriacetic acid, cyclohexanediaminetetraacetic acid, iminodiacetic acid, N-hydroxymethylethylenediaminetriacetic acid or diethylenetriaminepentaacetic acid as water softeners.

Competing couplers and compensating developing agents also may be added to the color developing solution.

As competing couplers, citrazinic acid, J-acid, and H-acid, are useful.

As the compensating developing agents, p-aminophenol, N-benzyl-p-aminophenol and 1-phenyl-3-pyrazolidone, may be used.

The pH of the color developing solution is preferred to be in a range of about 8 to 13. Temperature of the color developing solution is selected between about 20° C. and 70° C., preferably between about 30° C. and 60° C.

After color development, the photographic emulsion layers are generally bleached. Bleaching may be carried out simultaneously with or separately from fixing. As bleaching agents, compounds of polyvalent metals such as iron (III), cobalt (IV), chromium (VI), and copper (II), peracids, quinones and nitron compounds are used. For example, it is possible to use ferricyanides, bichromates, organic complex salts of iron (III) or cobalt (III), including complex salts of aminopolycarboxylic acids such as ethylenediaminetetraacetic acid, nitrilotriacetic acid, and 1,3-diamino-2-propanol-tetraacetic acid, or complex salts of organic acids such as citric acid or tartaric acid, persulfates, permanganates, and nitrosophenol. Of these, potassium ferricyanide, iron (III) sodium ethylenediaminetetraacetate and iron (III) ammonium ethylenediaminetetraacetate are particularly useful. Iron (III) aminopolycarboxylates are useful in both an independent bleaching solution and a one-bath bleach-fix solution.

Various additives including bleaching accelerators described in U.S. Pat. Nos. 3,042,520 and 3,241,966 and Japanese Patent Publication Nos. 8506/70 and 8836/70 may be added to the bleaching solution or the bleach-fix solution.

For the fixing bath, ammonium, sodium or potassium thiosulfate is used as a fixing agent in an amount of about 30 g/l to 200 g/l. Further, the fixing solution may contain stabilizers such as sulfites or hetero-metabisulfites, hardeners such as potash alum, and pH buffering agents such as acetates, borates, phosphates or carbonates. The pH of the fixing solution ranges from about 3 to 10, preferably from about 5 to 9.

The present invention is illustrated in greater detail with reference to the following examples, which are not to be construed as limiting the scope thereof. Unless otherwise indicated, all parts, percents and ratios are by weight.

EXAMPLE

On a triacetate film base a 1st layer to 11th layer described below were applied in the following order to prepare a color reversal photographic light-sensitive material (Sample 1):

1st layer: Antihalation layer gelatin layer containing black colloidal silver was applied.

2nd layer: Gelatin intermediate layer A 10% aqueous solution of gelatin was applied so as to result in a dry film thickness of 2μ.

3rd layer: Low-speed red-sensitive emulsion layer An emulsion was obtained by stirring at high speed a solution of 100 g of a cyan coupler 2-(heptafluorobutyramido)-5-(2'-(2",4"-di-t-amylphenoxy)-butyramido)phenol in a mixture of 100 cc of tricresyl phosphate and 100 cc of ethyl acetate, together with 1 kg of a 10% aqueous solution of gelatin. 500 g of this emulsion was mixed with 1 kg of a red-sensitive silver bromoiodide emulsion (containing 70 g of silver and 60 g of gelatin, iodine content: 6% by mol), and the mixture was applied so as to result in a dry film thickness of 1μ (silver amount: 0.5 g/m²).

4th layer: High-speed red-sensitive emulsion layer An emulsion was obtained by stirring at high speed a solution of 100 g of a cyan coupler 2-(heptafluorobutyramido)-5-(2'-(2",4"-di-t-amylphenoxy)-butyramido)phenol in a mixture of 100 cc of tricresyl phosphate and 100 cc of ethyl acetate together with 1 kg of a 10% aqueous solution of gelatin. 1000 g of this emulsion was mixed with 1 kg of a red-sensitive silver iodobromide emulsion (containing 70 g of silver and 60 g of gelatin, iodine content: 6% by mol), and 7 ml of a solution of 0.2 g of 1-3-(3-(3-methylureido)-phenyl)-5-mercaptotetrazole in 100 ml of methyl alcohol was added thereto. The mixture was applied so as to result in a dry film thickness of 2.5μ (silver amount: 0.8 g/m²).

5th layer: Intermediate layer An emulsion was obtained by stirring at high speed a solution of 40 g of 2,5-di-t-octylhydroquinone in a mixture of 100 cc of dibutyl phthalate and 100 cc of ethyl acetate together with 1 kg of a 10% aqueous solution of gelatin. 1 kg of this emulsion was mixed with 1 kg of 10% aqueous gelatin solution, and the mixture was applied so as to result in a dry film thickness of 1μ.

6th layer: Low-speed green-sensitive emulsion layer An emulsion was obtained in the same manner as the emulsion of the 3rd layer, except 100 g of a magenta coupler of 1-(2,4,6-trichlorophenyl)-3-(3-(2,4-di-t-amylphenoxyacetamido)benzamido-5-pyrazolone was used in place of the cyan coupler. 300 g of this emulsion was mixed with 1 kg of a green-sensitive silver iodobromide emulsion (containing 70 g of silver and 60 g of gelatin; iodine content: 7% by mol), and the mixture was applied so as to result in a dry film thickness of 1.3μ (silver amount: 1.1 g/m²).

7th layer: High-speed green-sensitive emulsion layer An emulsion was obtained in the same manner as the emulsion of the 3rd layer, except 100 g of a magenta coupler 1-(2,4,6-trichlorophenyl)-3-(3-(2,4-di-t-amylphenoxyacetamido)benzamido)-5-pyrazolone was used in place of the cyan coupler. 1000 g of this emulsion was mixed with 1 kg of a green-sensitive silver iodobromide emulsion (containing 70 g of silver and 60 g of gelatin; iodine content: 6% by mol), and 100 ml of a solution of 0.01 g of 2-mercaptobenzothiazole in 100 ml of methyl alcohol was added thereto. The mixture was applied so as to result in a dry film thickness of 3.5μ (silver amount: 1.1 g/m²).

8th layer: Yellow filter layer An emulsion containing yellow colloidal silver was applied so as to result in a dry film thickness of 1μ.

9th layer: Low-speed blue-sensitive emulsion layer An emulsion was obtained in the same manner as the emulsion of the 1st layer, except 100 g of a yellow coupler α-(pivaloyl)-α-(1-benzyl-5-ethoxy-3-hydantoinyl)-2-chloro-5-dodecyloxycarbonylacetanilide was used in place of the cyan coupler. 1000 g of this emulsion was mixed with 1 kg of a blue-sensitive silver iodobromide emulsion (containing 70 g of silver and 60 g of gelatin, iodine content: 7% by mol), and the mixture was applied so as to result in a dry film thickness of 1.5μ (silver amount: 0.4 g/m²).

10th layer: High-speed blue-sensitive emulsion layer An emulsion was obtained in the same manner as the emulsion of the 1st layer, except 100 g of a yellow coupler α-(pivaloyl)-α-(1-benzyl-5-ethoxy-3-hydantoinyl)-2-chloro-5-dodecyloxycarbonylacetanilide was used in place of the cyan coupler. 1000 g of this emulsion was mixed with 1 kg of a blue-sensitive silver iodobromide emulsion (containing 70 g of silver and 60 g of gelatin, iodine content: 6% by mol), and the mixture was applied so as to result in a dry film thickness of 3μ (silver amount: 0.8 g/m²).

11th layer: Protective layer A 10% solution of gelatin was applied so as to result in a dry film thickness of 2.8μ.

In order to confirm the effect of the present invention, sample 1 produced as described above was compared with photographic materials containing a silver halide emulsion having substantially not light-sensitivity prepared as follows:

After a silver iodobromide emulsion (silver added: 2% by mol) was prepared from silver nitrate, potassium bromide and potassium iodide by a conventional neutral process, it was washed by a precipitation process to obtain an emulsion. The average particle size of silver iodobromide grains was about 0.06 microns.

(Production of samples 2–9)

Samples 2–7 were produced by the same manner as sample 1, except that the above described silver halide emulsion having substantially no light-sensitivity and compound (1) of the present invention were added to the 2nd layer of sample 1 in an amounts shown in Table 1.

Samples 8 and 9 were produced by the same manner as Sample 1, except that the above described silver halide emulsion having substantially no light-sensitivity and Comparative Compounds (a) or (b) were added to the 2nd layer of Sample 1 in amounts shown in Table 1.

Samples 1–9 produced were exposed to white light through a wedge for sensitometry using a 4800K light source with an illluminance at the exposed face of 1000 luxes, and they were then subjected to the following standard reversal processing to obtain color images. The processing steps and processing solutions used were as follows. Reversal processing step

| Step | Time | Temperature |
|---|---|---|
| First development | 6 minutes | 38° C. |
| Water wash | 2 minutes | " |
| Reversing | 2 minutes | " |
| Color development | 6 minutes | " |
| Conditioning | 2 minutes | " |
| Bleaching | 6 minutes | " |
| Fixing | 4 minutes | " |
| Water wash | 4 minutes | " |
| Stabilization | 1 minute | room temperature |

Compositions of the processing solutions used were as follows.

| First developing solution: | |
|---|---|
| Water | 700 ml |
| Sodium tetrapolyphosphate | 2 g |
| Sodium sulfite | 20 g |
| Hydroquinone monosulfonate | 30 g |

-continued

| | |
|---|---|
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1000 ml |
| | (pH 10.1) |
| Reversing solution: | |
| Water | 700 ml |
| Nitro-N,N,N—trimethylene phosphonic acid 6Na salt | 3 g |
| Stannous chloride (dihydrate) | 1 g |
| p-Aminophenol | 0.1 g |
| Sodium hydroxide | 8 g |
| Glacial acetic acid | 15 ml |
| Water to make | 1000 ml |
| Color developing solution: | |
| Water | 700 ml |
| Sodium tetrapolyphosphate | 2 g |
| Sodium sulfite | 7 g |
| Sodium tertiary phosphate (12 hydrate) | 36 g |
| Potassium bromide | 1 g |
| Potassium iodide (0.1% solution) | 90 ml |
| Sodium hydroxide | 3 g |
| Citrazinic acid | 1.5 g |
| N—Ethyl-N—(β-methanesulfonamidoethyl)-3-methyl-4-aminoaniline sulfate | 11 g |
| Ethylenediamine | 3 g |
| Water | 1000 ml |
| Conditioning solution: | |
| Water | 700 ml |
| Sodium sulfite | 12 g |
| Sodium ethylenediaminetetraacetate (dihydrate) | 8 g |
| Thioglycerine | 0.4 ml |
| Glacial acetic acid | 3 ml |
| Water to make | 1000 ml |
| Bleaching solution: | |
| Water | 800 g |
| Sodium ethylenediaminetetraacetate (dihydrate) | 2.0 g |
| Iron (III) ammonium ethylenediamine-tetraacetate (dihydrate) | 120.0 g |
| Potassium bromide | 100.0 g |
| Water to make | 1000 ml |
| Fixing solution: | |
| Water | 800 ml |
| Ammonium thiosulfate | 80.0 g |
| Sodium sulfite | 5.0 g |

-continued

| | |
|---|---|
| Sodium bisulfite | 5.0 g |
| Water to make | 1000 ml |
| Stabilizing solution: | |
| Water | 800 ml |
| Formalin (37% by weight) | 5.0 ml |
| Fuji Driwel (containing surface active agent) | 5.0 ml |
| Water to make | 1000 ml |

In this test, since a cyan coupler was contained in the dye forming layer nearest the auxiliary layer (i.e., the 2nd layer; a gelatin intermediate layer), the optical density of the cyan image formed in each sample was measured through a red filter, and the effect of the present invention was evaluated by the characteristic curve obtained. Sensitivity was calculated as the reciprocal of an exposure amount necessary to obtain a definite density (D=1.00) of cyan color, which was determined from the characteristic curve. Further, gradation of the low density section was evaluated by gamma which was calculated as the difference of density between density D′ the exposure amount of which was Δ log (exposure amount)=0.30 smaller than the value of log (exposure amount) of density D=0.30, and density: D=0.30.

The results obtained are shown in Table 1.

The data in Table 1 demonstrate that samples containing only the silver halide emulsion having substantially no light-sensitivity in the 2nd layer (gelatin intermediate layer) (Sample Nos. 3 and 4) had a soft gradation and increased minimum density. It is further shown that the sample containing only compound (1) in the 2nd layer (Sample No. 2) had increased relative sensitivity, but gradation of the low density part hardly changed and that Sample Nos. 8 and 9 had an insufficient gradation of the low density section to provide hard tone.

However, when both compound (1) and the silver halide emulsion having substantially no light-sensitivity were incorporated in the 2nd layer, as shown in Sample Nos. 5, 6 and 7, the gradation of the low density part became hard and the relative sensitivity increased. It is also demonstrated that gradation and hardness can be controlled by controlling amounts of the compound and the silver halide coated.

TABLE 1

| | Composition of the 2nd Layer (gelatin intermediate layer) | | Photographic Properties | | |
|---|---|---|---|---|---|
| Sample No. | Coating amount of Compound (1) (mol/m²) | Coating amount of insensitive silver halide (Ag amount coated g/m²) | Relative Sensitivity | Gamma (density: 0.3) | Minimum density |
| 1 Comparison | — | — | 100 | 0.14 | 0.16 |
| 2 Comparison | $1.72 \times 10^{-4}$ | — | 115 | 0.15 | 0.16 |
| 3 Comparison | — | 0.131 | 105 | 0.10 | 0.22 |
| 4 Comparison | — | 0.262 | 110 | 0.08 | 0.22 |
| 5 Invention | $0.86 \times 10^{-4}$ | 0.262 | 120 | 0.20 | 0.18 |
| 6 Invention | $1.72 \times 10^{-4}$ | 0.262 | 126 | 0.27 | 0.16 |
| 7 Invention | $2.58 \times 10^{-4}$ | 0.393 | 135 | 0.30 | 0.15 |
| 8 Comparison | $1.72 \times 10^{-4}$ (Comparative Compound (a)) | 0.262 | 115 | 0.11 | 0.19 |
| 9 Comparison | $1.72 \times 10^{-4}$ | 0.262 | 118 | 0.12 | 0.18 |

TABLE 1-continued

| Sample No. | Composition of the 2nd Layer (gelatin intermediate layer) Coating amount of Compound (1) (mol/m$^2$) | Coating amount of insensitive silver halide (Ag amount coated g/m$^2$) | Photographic Properties Relative Sensitivity | Gamma (density: 0.3) | Minimum density |
|---|---|---|---|---|---|
| | (Comparative Compound (b)) | | | | |

Comparative Compound (a)

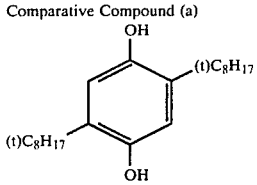

Comparative Compound (b)

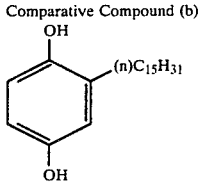

While the invention has been described in detail and with reference to specific examples thereof, it will be apparent to one skilled in the art that various changes and modifications can be made therein without departing from the spirit and scope thereof.

What is claimed is:

1. A color reversal photographic light-sensitive materials comprising a base having thereon (a) at least one light-sensitive silver halide emulsion layer containing a dye forming coupler and (b) a silver halide emulsion layer substantially without light-sensitivity provided adjacent to said light-sensitive layer, or (a) at least one light-sensitive silver halide emulsion layer containing a dye forming coupler, (b) a silver halide emulsion layer substantially without light-sensitivity to light, and (c) an intermediate layer therebetween, wherein said silver halide emulsion layer substantially without light-sensitivity, or both said intermediate layer and said silver halide emulsion layer substantially without light-sensitivity contain at least one compound represented by the following formula (I):

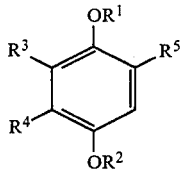

(I)

wherein $R^1$ and $R^2$, which may be the same or different, each represents a hydrogen atom or a group having 1 to 10 carbon atoms capable of being hydrolyzed with alkali, $R^3$, $R^4$ and $R^5$ each represents a hydrogen atom, a sulfo group, a carboxyl group, a sulfoalkyl group having 1 to 6 carbon atoms, a carboxyalkyl group having 1 to 6 carbon atoms or an alkyl group having 1 to 22 carbon atoms, provided that at least one of $R^3$, $R^4$ and $R^5$ is a group selected from a sulfo group, a carboxyl group, a sulfoalkyl group and a carboxyalkyl group, and at least one of $R^3$, $R^4$ and $R^5$ is an alkyl group.

2. The color reversal photographic light-sensitive material claimed in claim 1, wherein $R^1$ and $R^2$ each represents a hydrogen atom, and $R^3$, $R^4$ and $R^5$ each represents a sulfo group, a carboxyl group, or an alkyl group.

3. The color reversal photographic light-sensitive material claimed in claim 2, wherein $R^5$ represents a sulfo group or a carboxyl group, one of $R^3$ and $R^4$ represents an alkyl group, and the other represents a hydrogen atom.

4. The color reversal photographic light-sensitive material claimed in claim 3, wherein $R^3$ represents a hydrogen atom, $R^4$ represents an alkyl group and $R^5$ represents a sulfo group.

5. The color reversal photographic light-sensitive material claimed in claim 1, wherein the silver halide grains contained in said silver halide emulsion layer substantially without light-sensitivity are smaller than the silver halide grains in said light-sensitive silver halide emulsion layer, and have an average particle size of less than about 0.1$\mu$.

6. The color reversal photographic light-sensitive material claimed in claim 5, wherein the sensitivity to light of said silver halide emulsion layer substantially without light-sensitivity is less than about 1/10 the light-sensitivity of said light-sensitive silver halide emulsion layer.

7. The color reversal photographic light-sensitive material claimed in claim 1, wherein the compound represented by general formula (I) and the silver halide emulsion substantially without light-sensitivity are contained in the same layer in an amount of about 0.01 to about 1.00 mol of the compound represented by general formula (I) per mol of silver halide substantially without light-sensitivity.

8. The color reversal photographic light-sensitive material claimed in claim 1, wherein the compound represented by general formula (I) is used in an amount of about $0.4\times10^{-4}$ mols/m$^2$ to about $6\times10^{-4}$ mols/m$^2$ in a case that the compound is incorporated in the different layer from the layer in which the silver halide emulsion substantially without light-sensitivity is contained.

9. The color reversal photographic light-sensitive material claimed in claim 1, wherein the layer containing silver halide emulsion substantially without light-sensitivity is adjacent to the light-sensitive silver halide emulsion layer and the amount of silver halide substantially without light-sensitivity is in a range of about 0.01 to 1.00 mol per mol of light-sensitive silver halide.

10. The color reversal photographic light-sensitive material claimed in claim 1, wherein the layer containing silver halide emulsion substantially without light-sensitivity is not adjacent to the light-sensitive silver halide emulsion layer and the amount of silver halide substantially without light-sensitivity is in a range of about $10^{-4}$ mols/m$^2$ to about $10^{-2}$ mols/m$^2$.

11. The color reversal photographic light-sensitive material claimed in claim 1, wherein the silver halide emulsion layer substantially without light-sensitivity containing the compound represented by general formula (I) is provided under the light-sensitive silver halide emulsion layer.

12. The color reversal photographic light-sensitive material claimed in claim 11, wherein the silver halide emulsion layer substantially without light-sensitivity containing the compound represented by general formula (I) is provided under the light-sensitive silver halide emulsion layer nearest to the base.

13. A process for forming an image, comprising in sequence, developing in a black and white developing solution, reversing, developing in a color developing solution, bleaching and fixing an imagewise exposed color reversal photographic light-sensitive material comprising a base having thereon (a) at least one light-sensitive silver halide emulsion layer containing a dye forming coupler and (b) a silver halide emulsion layer substantially without light-sensitivity provided adjacent to said light-sensitive layer, or (c) at least one light-sensitive silver halide emulsion layer containing a dye forming coupler, (d) a silver halide emulsion layer substantially without light-sensitivity to light, and (e) an intermediate layer therebetween, wherein said silver halide emulsion layer substantially without light-sensitivity, or both said intermediate layers and said silver halide emulsion layer substantially without light-sensitivity contain at least one compound represented by the following formula (I):

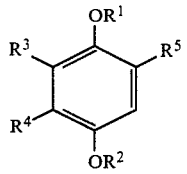

(I)

wherein $R^1$ and $R^2$, which may be the same or different, each represents a hydrogen atom or a group having 1 to 10 carbon atoms capable of being hydrolyzed with alkali, $R^3$, $R^4$ and $R^5$ each represents a hydrogen atom, a sulfo group, a carboxyl group, a sulfoalkyl group having 1 to 6 carbon atoms, a carboxyalkyl group having 1 to 6 carbon atoms or an alkyl group having 1 to 22 carbon atoms, provided that at least one of $R^3$, $R^4$ and $R^5$ is a group selected from a sulfo group, a carboxyl group, a sulfoalkyl group and a carboxyalkyl group, and at least one of $R^3$, $R^4$ and $R^5$ is an alkyl group.

14. A process as in claim 13, wherein $R^1$ and $R^2$ each represents a hydrogen atom, and $R^3$, $R^4$ and $R^5$ each represents a sulfo group, a carboxyl group, or an alkyl group.

15. A process as in claim 14, wherein $R^5$ represents a sulfo group or a carboxyl group, one of $R^3$ and $R^4$ represents an alkyl group, and the other represents a hydrogen atom.

16. A process as in claim 15, wherein $R^3$ represents a hydrogen atom, $R^4$ represents an alkyl group and $R^5$ represents a sulfo group.

17. A process as in claim 13, wherein the silver halide grains contained in said silver halide emulsion layer substantially without light-sensitivity are smaller than the silver halide grains in said light-sensitive silver halide emulsion layer, and have an average particle size of less than about 0.1$\mu$.

18. A process as in claim 17, wherein the sensitivity to light of said silver halide emulsion layer substantially without light-sensitivity is less than about 1/10 the light sensitivity of said light-sensitive silver halide emulsion layer.

19. A process as in claim 13, wherein the compound represented by general formula (I) and the silver halide emulsion substantially without light-sensitivity are contained in the same layer in an amount of about 0.01 to about 1.00 mol of the compound represented by general formula (I) per mol of silver halide substantially with light-sensitivity.

20. A process as in claim 13, wherein the compound represented by general formula (I) is used in an amount of about $0.4\times10^{-4}$ mols/m$^2$ to about $6\times10^{-4}$ mols/m$^2$ in a case that the compound is incorporated in the different layer from the layer in which the silver halide emulsion substantially without light-sensitivity is contained.

21. A process as claimed in claim 13, wherein the layer containing silver halide emulsion substantially without light-sensitivity is adjacent to the light-sensitive silver halide emulsion layer and the amount of silver halide substantially without light-sensitivity is in a range of about 0.01 to 1.00 mol per mol of light-sensitive silver halide.

22. A process as claimed in claim 13, wherein the layer containing silver halide emulsion substantially without light-sensitivity is not adjacent to the light-sensitive silver halide emulsion layer and the amount of silver halide substantially without light-sensitivity is in a range of about $10^{-4}$ mols/m$^2$ to about $10^{-2}$ mols/m$^2$.

23. A process as claimed in claim 13, wherein the silver halide emulsion layer substantially without light-sensitivity containing the compound represented by general formula (I) is provided under the light-sensitive silver halide emulsion layer.

24. A process as claimed in claim 23, wherein the silver halide emulsion layer substantially without light-sensitivity containing the compound represented by general formula (I) is provided under the light-sensitive silver halide emulsion layer nearest to the base.

* * * * *